US005154415A

United States Patent [19]

Zotos

[11] Patent Number: 5,154,415

[45] Date of Patent: Oct. 13, 1992

[54] CUE BALL ACCURATE REBOUND TOOL

[76] Inventor: Michael R. Zotos, 45 First Ave., Holtsville, N.Y. 11742

[21] Appl. No.: 812,746

[22] Filed: Dec. 24, 1991

[51] Int. Cl.[5] ..... A63D 15/00

[52] U.S. Cl. ..... 273/14

[58] Field of Search ..... 273/2, 14

[56] References Cited

U.S. PATENT DOCUMENTS

| | | | |
|---|---|---|---|
| 2,537,228 | 1/1951 | Matson | 273/14 |
| 3,220,122 | 11/1965 | Miller | 273/14 |
| 3,299,537 | 1/1967 | Franks | 273/14 |
| 3,463,593 | 8/1969 | Horan | 273/14 |
| 4,178,694 | 12/1979 | Bonney | 273/14 |

FOREIGN PATENT DOCUMENTS

| | | |
|---|---|---|
| 323795 | 1/1930 | United Kingdom . |
| 2152390 | 8/1985 | United Kingdom . |
| 2187647 | 9/1987 | United Kingdom . |
| 2238481 | 6/1991 | United Kingdom . |

*Primary Examiner*—Theatrice Brown

[57] ABSTRACT

The device consists of a protractor member attached to a board member at the straight edge of the protractor member. It attaches to the rail of the table so that the straight edge of the protractor member is directly over the inside edge of the rebound cushion, and can be slid along the rail of the table from side to side. There are two weighted posts with draw twines attached at their tops. One of the posts is situated on the table at the exact point that the ball is presently at, while the other post is situated on the table at the exact spot that the ball is to end up after it rebounds off the cushion. Each of the twines is drawn to the center point of the straight edge of the protractor member. This creates a straight line from each post to the center point of the straight edge of the protractor member. The existence of both of these straight lines creates an angle from one post to the center point of the straight edge of the protractor member to the other post that can be seen and identified on the face of the protractor member. As the base is moved from side to side on the rail this angle changes. Guide marks on the protractor member give a measurement of each line from the forward center of the protractor member referred to as the ninety degree point. The base can be moved from side to side until both lines are at an equal distance from the ninety degree point. A chalk basin situated on the base, at the center point of the straight edge of the protractor member is now automatically over that point.

6 Claims, 3 Drawing Sheets

CUE BALL ACCURATE REBOUND TOOL

BACKGROUND OF THE INVENTION

1. Field of the Invention

The present invention is a device to be used in the game known as "POOL" or "BILLIARDS". It is used to indicate the point on the cushion of a pool table that a ball needs to strike in order to rebound into a specific pocket, or in order to rebound into a specific ball to drive that ball into a specific pocket. The tool is designed to be a learning aid for those people interested in developing their skill at rebound shots in the game of pool or billiards.

The game of pool is a game of skill which is developed over time with practice. One learns to be able to hit a ball into another ball with a cue stick, and send it into a pocket. Many of these shots require the player to successfully rebound the ball off a cushion and into the ball that is to enter the pocket, or to hit the ball, commonly referred to as the cue ball, into the ball that is to enter the pocket at such an angle as to cause it to rebound off a cushion and into the pocket. These shots, known as "bank shots", are most difficult to master. The reason being that no two shots are exactly the same. Each time a person attempts a bank shot and fails, the shot has disappeared and cannot easily be analyzed. Compounded with this problem is the fact that a bank shot is an angle shot. Once a ball leaves the cushion that it has been caused to strike, and moves in a direction at a degree that was not intended, the distance that it travels before contacting another ball or cushion largely determines how far "off" the bank shot might be. This creates a distorted view of the inaccuracy of the unsuccessful bank shot, and relieves the player of the ability to learn from his mistakes. It is therefore beneficial for the player to have the ability to see in advance of attempting a bank shot, where on the cushion the ball must rebound in order for the shot to be made. And for that purpose I have invented the Cue Ball Accurate Rebound Tool.

2. Description of the Related Art

It is a well known fact that a cue ball will leave a cushion at the same angle at which it strikes the cushion. The distance to or from that cushion is not relevant. Only where the ball is, where it must end up, and then where on the cushion that same angle is located.

Numerous prior art devices have been devised to aid a player in improving his skill in shooting pool. The following references display forms of devices whereby a ball rebound point is determined for banking a ball off of the table cushion and thus into a designated pocket. Reference, 2,537,228, (MATSON) displays a ball rebound angle, indicator having a pair of rigid arms pivotally attached to a member for connecting the apparatus to a rail of a pool table. The reference, 3,463,593 (HORAN) shows a protractor shaped device made in the form of a curved mirror and having a plurality of equally spaced graduation for aligning a ball with a ball rebound spot located on a cushion with a designated pocket. Although these references do tend to address the solution to a problem in which I am proposing, the manner of aligning a ball for rebounding from a predetermined spot on a table cushion and into a designated pocket as the reference disclose is in no way seen to be compatible to the new apparatus which I have invented and disclosed herein.

SUMMARY

The Cue Ball Accurate Rebound Tool is a lightweight device that is easily set up on the pool table, operated, and removed, before the shot is attempted. Leaving only a chalk mark on the cushion at the precise spot on the cushion that the ball must strike in order for the shot to be made.

DESCRIPTION OF THE PREFERRED EMBODIMENTS

Figure 1:
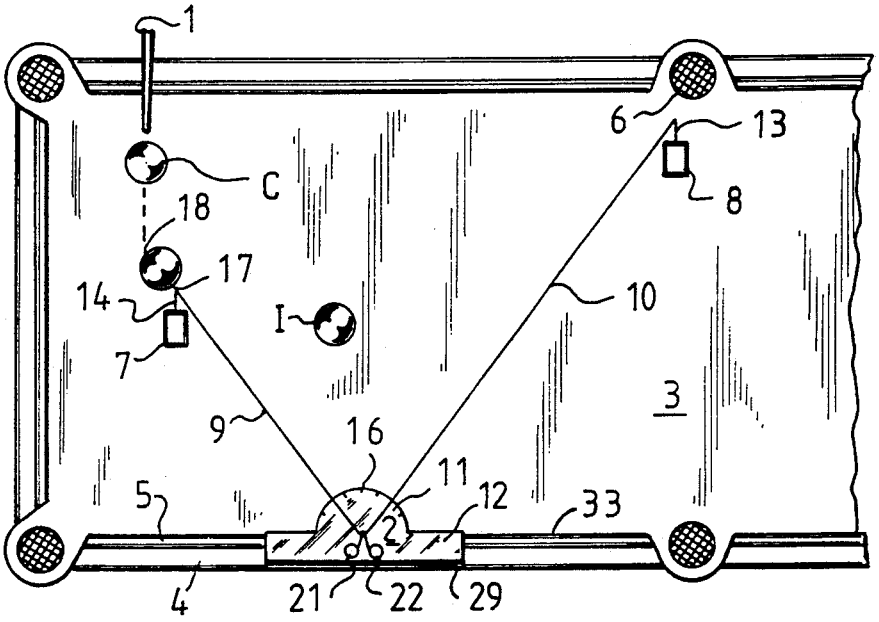
FIGS. 1 and 6 are overhead views of the Cue Ball Accurate Rebound Tool set up on a pool table. These views show the device as it would appear once the exact identical angle has been located.
Figure 2:
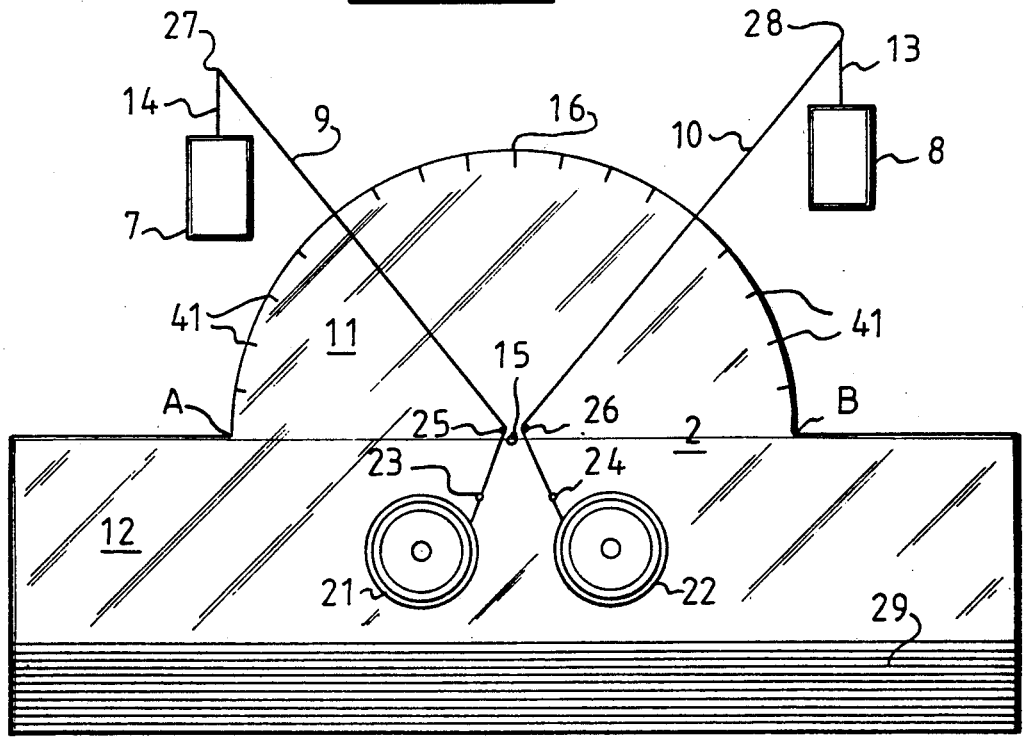
FIG. 2 shows the Cue Ball Accurate Rebound Tool in an overhead view in precisely the same state as FIGS. 1 and 6. This view shows the device in graphic detail from overhead.

The Cue Ball Accurate Rebound Tool #2 consists mainly of a protractor element #11, attached to a board element #12. These parts should be made of a strong clear plastic, and it is preferred that they are casted as a single part. It is most important that the protractor element #11, FIG. 1, be a one half circle that will extend over the cushion of the pool table #5, when the board element #12 is placed on the top of the rail of the pool table #4. There is a front retaining lip #19 FIG. 3, that is designed to keep the protractor element #11 in a position so that the points (A) and (B) will both be flush over the edge of the cushion #33. This front lip #19 extends down from the point where the protractor element #11 meets the board element #12, and runs from point (A) to point (B), interrupted only in the center, where a chalk basin #20 is situated. This front retaining lip #19 extends downward only about one half inch, just enough so that it will hug the inside of the cushion edge #33, thereby leaving the entire one half circle of the protractor element #11 hanging over the table #3, and its straight edge (A-B) flush with the edge of the cushion #33.

Figure 3:
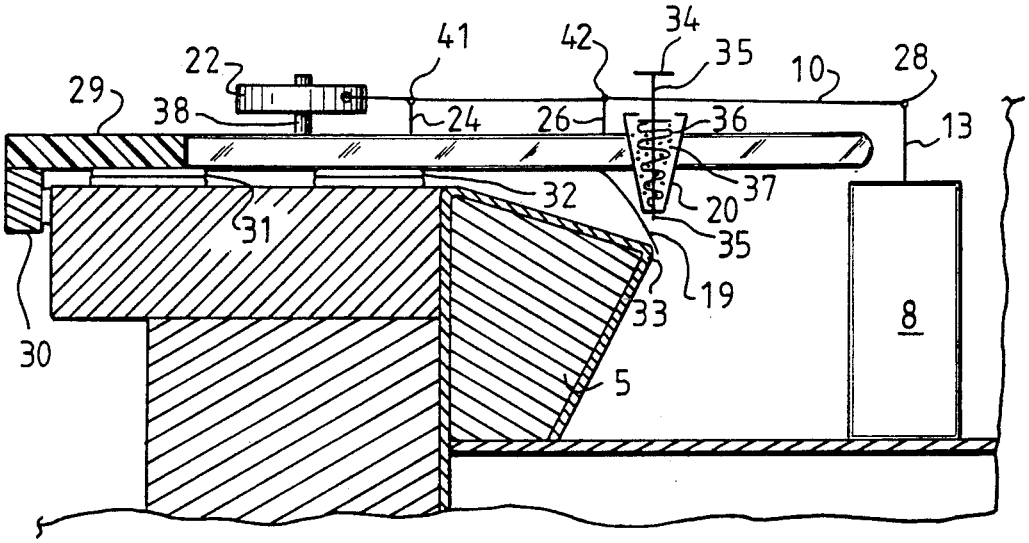
FIG. 3 shows the Cue Ball Accurate Rebound Tool from a side view as it would appear set up on a pool table.

The board element #12 has a more heavily weighted back area #29, and a rear retaining lip #30, and has pads attached under it #31 and #32, FIG. 3. These are to keep the base #12 stabile on the rail #4 while the device is being operated. The rear retaining lip #30 need only be about one quarter of an inch deep, and may run the entire rear edge of the board element #12. It is only there to keep the device from falling forward and onto the table during operation.

The main body of the Cue Ball Accurate Rebound Tool #2 is placed on the rail #4 of the pool table in an approximate location where the player believes the subject ball (S) must strike in order for the shot to be made. One of two weighted posts #8 is moved out, onto the pool table #3, and situated in front of the target pocket #6 FIG. 1. This post has a needle on the top of it #13, so that a very precise location on the table can be made by eye. It is important that the post be situated so that a ball traveling from the center point #15, toward the post #8 along the line created by the two; (line 15-8), would fall into the target pocket #6 if it were to travel so far. The needle #13, attached to the post #8, has the end of a twine #10 attached to it at its tip #28. This twine is drawn out of a retracting twine spindle #22. It is important to note that the twine #10 is kept in a certain position on the base #2 by guide needles #24 and #26. These guide needles each have an eye at their tip #41 and #42 FIG. 3. These eyes allow the twine #10 to flow freely through, but keep the twine #10 situated in its position. The position of these guide needles #24 and #26 is very important. Guide needle #24 keeps the twine #10 flowing out of the twine spindle #22 and guided toward guide needle #26. Guide needle #26 keeps the twine's drawn end as close to the center point #15 of the protractor element #11 as possible. This will be important when the angle is located. The retracting twine spindle #22 keeps tension on the twine #10 as the post #8 is moved out, or in, and situated. This tension serves to create a straight line from the point that the twine #10 is drawn from; guide needle #26, and the post #8 in front of the target pocket #6. This line will remain straight even when the base #2 is moved from side to side along the rail #4.

Figure 4:
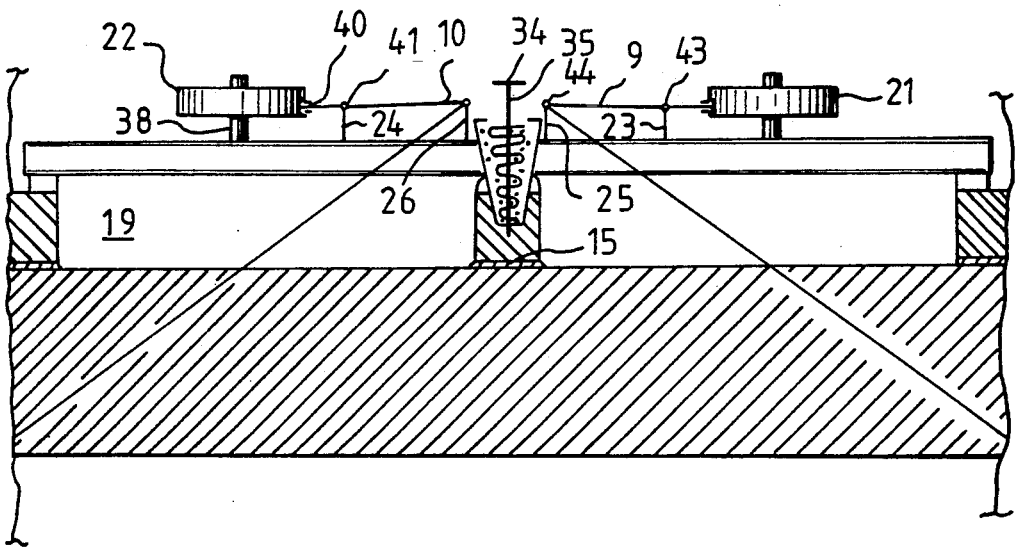
FIG. 4 shows the Cue Ball Accurate Rebound Tool from a front view as it would appear set up on a pool table.

The other of the two weighted posts #7 is moved out, onto the pool table #3, and situated at the subject ball (S). It is very important that the post #7 is placed at a certain point #17 FIG. 1, which is a point at the subject ball (S), that it must descend from if it is to travel toward the protractor element #11, and reach the center point #15. The best way to locate this point is to take aim at the subject ball (S) with a cue stick #1, from the point away from the protractor element #18 FIG. 1, aiming as if the player intends to strike the subject ball (S) and send it to the center point #15. The proper descend point of the ball is directly opposite that point #18, and on the other side of the ball #17. The post #7 has a needle on the top of it #14 to make it easy to situate the post #7 in the exact spot that the ball must descend from #17. At the end of this needle #27 is a twine #9. This twine is drawn from a retracting twine spindle #21, which maintains tension on the twine #9. The twine #9 travels through the eyes #43 and #44 FIG. 4, of guide needles #23 and #25. These guide needles #23 and #25 are very important because they keep the twine flowing from the right position. Guide needle #23 keeps the twine flowing to guide needle #25. Guide needle #25 keeps the twine's drawn end as close to the center point #15, of the protractor element as possible. The retracting twine spindle #21 keeps tension on the twine as post #7 is moved. This tension serves to create a straight line from the point that the twine is drawn from; guide needle #25, and the post #7 in front of the subject ball (S). This line will remain straight even if the base #2 is moved from side to side along the rail #4.

With the first post #8 situated at the target pocket #6, and the other post #7 situated at the subject ball(S), and the base #12 situated on the rail of the pool table #4, there are nov two straight lines created by the two twines #10 and #9 which almost meet at the center point #15, and thereby form an angle (angle 27-15-28). As the base #12 is moved from side to side along the rail #4, with the diameter line (A-B) flush along the cushion edge #33, the angle (27-15-28) can be changed. As this is being done the mark along the protractor element #41 which each twine #10 and #9 meets changes.

The marks #41 along the protractor element #11 are measurement marks. These are to indicate a distance that the twine is from the ninety degree mark #16. The object is to move the base #2 along the rail #4, from side to side until the twine on one side #10 is at the measurement mark #41 that is equally distant from the ninety degree mark #16, as the measurement mark #41 that the other twine #9 is at, is from the ninety degree mark #16 in the other direction. Thereby locating the spot on the cushion where the angle formed by the ninety degree mark #16, the center point #15, and the first post twine point #28 (angle 16-15-28) is equal to that formed by the ninety degree mark #16, the center point #15, and the other post twine point #27 (angle 16-15-27). At this point the entire devise is set up and the angle has been located. Now it is necessary to identify that spot #15. It is important to note that if the base #2 has had to be moved a great distance from its original position in order to locate angle, that the location of the posts #8 and #7 may now be wrong. That is that the top of the post #28 may no longer be directly in front of the target pocket #6 in a direct line from the center point #15 toward that top point #28. And the top of the other post #27 may no longer be at the exact point that the subject ball (S) must descend from #17 in order to reach the center point #15. Such a situation should be easy to see with the eye. In such a case the posts #8 and #7 will need to be moved to the appropriate spots, and the base #2 will need to be moved again to locate the correct angle point.

Once the correct angle point is located the chalk basin #20 will be situated directly over that point automatically. The chalk button #34 is then pushed. This forces the chalk needle #35 to descend down, through the powdered chalk #37, and to make contact with the inside cushion edge #33 at the center point #15, thereby leaving a chalk mark indicating the exact spot on the cushion that the subject ball (S must strike in order to rebound into the target pocket #6. When the chalk button #34 is released, the chalk button return spring #36 forces the chalk needle #35 back up the chalk basin #20, and away from the cushion edge. Now the entire device is removed from the pool table and the player may analyze and execute the shot successfully.

Figure 6:
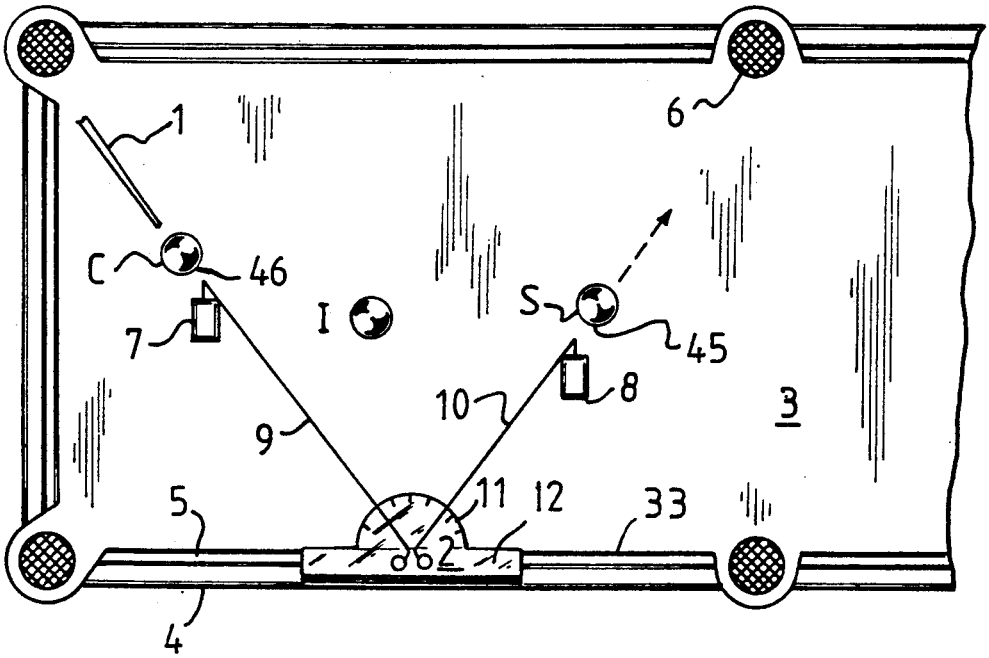

Certain bank shots require that the cue ball (C) be hit and forced to rebound off the cushion #5 before striking the subject ball (S) as in FIG. 6. Here there is an interference ball (I) which may hinder a direct shot from the cue ball (C) to the subject ball (S). In this instance the Cue Ball Accurate Rebound Tool is used in the same way as in the previous explanation and pictured in FIG. 1. Here the base #2 is attached to the rail #4 in exactly the same way. But the first post #8 is not situated in front of the target pocket. Instead it is situated to the back of the subject ball (S) at the exact point that the subject ball (S) would need to be struck #45 in order to send it into the target pocket #6. And the other post #7 is not situated at the subject ball (S) at all. Instead it is situated at the cue ball(C), at the exact point that the cue ball(C) would need to descend from #46 if it was to travel directly toward the center point #15. The base #2 is then moved and operated in the same way as it is in the previous example.

Figure 5:
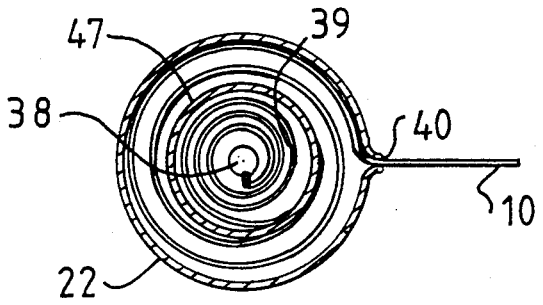
FIG. 5 shows a top view of a retracting twine spindle, one of the important parts of the device. This view is drawn to show the spindle as it would appear uncovered. It is a view of the insides of the part shown.

The retracting twine spindle shown in detail in FIG. 5 is a very important part of the Cue Ball Accurate Rebound Tool. It stands stationary on the spindle post #38. The twine #10 is wound around an inner spindle #47 and is drawn out through the twine hole #40 in the side of the spindle #22. As the twine #10 is drawn out, the inner spindle #47 spins on the spindle post #38. As the inner spindle #47 spins it wraps the inner spindle tape #39 more tightly around the spindle post #38. The inner spindle tape #39 is a tape made of metal and is attached to the stationary spindle post #38 at one end, and is attached to the inner spindle #47 at the other end. As the twine #10 is drawn out, the inner spindle #47 spins which wraps the inner spindle tape #39 more tightly around the spindle post #38 and creates more tension.

I claim:

1. A rebound point locator device for pool and billiard tables having rebound cushions and rails, comprising:

a protractor member, said protractor member having a half circle arcuate portion and a straight portion, said straight portion having first and second connecting points connecting respective ends of said arcuate portion, said arcuate portion having a 90 degree mark and a plurality of measuring marks thereon, said 90 degree mark being on an imaginary line extending perpendicular from said straight portion and from a point on said straight portion midway between said first and second points, and said measuring marks being equally spaced in opposite directions from said 90 degree mark;

means for attaching said protractor member to the rail and cushion of a pool table, whereby said protractor member will rest along the inside edge of the rebound cushion;

a pair of post means for being independently and movably positioned at predetermined locations on a pool table playing surface remote from said protractor member;

a pair of elongated connector means, said connector means extending from a respective post means to said protractor;

attachment means attaching one end of each connector of said pair of connector means to a respective post means and its other end to said protractor member substantially at said mid-point.

2. The rebound point locator device as defined in claim 1, wherein said means for attaching said protractor member to the rail and cushion extend over a horizontal top portion and downward along an outer vertical portion of the rail, and pad means positioned between said means for attaching and the rail.

3. The rebound point locator device as defined in claim 1, wherein, said connector means is twine, said post means has a predetermined weight, and said attachment means attachment said connector means to said post is a needle having an eye which receives said one end of said twine, and wherein said means for attaching said other end of said connector means to said protractor member is, a retracting twine spindle whereby the length of said twine may be increased or decreased as a said post is moved relative to said protractor member.

4. The rebound point location as defined in claim 3, wherein, said spindle is comprised of a stationary spindle post and a spring biased rotatable spindle for rotating about the longitudinal axis of said stationary spindle post, said other end of said twine being attached to said rotating spindle.

5. The rebound point locator device as defined in claim 1, wherein, said protractor member is provided with means at said mid-way point for placing an indicator mark on the pool table cushion.

6. The rebound point locator device as defined in claim 5, wherein, said means for placing an indicator mark is a basin for holding a powdered chalk therein, said basin having a chalk dispensing opening and a plunger extending into said opening, said plunger being, spring biased to close said opening, said opening, being opened to dispense a powder when said plunger is manually moved against said spring bias, thus placing said mark on a said cushion.

* * * * *